US005371949A

United States Patent [19]

Delaurier

[11] Patent Number: 5,371,949

[45] Date of Patent: Dec. 13, 1994

[54] METHOD AND TAPE CONSTRUCTION FOR LAYING OUT A BASEBALL DIAMOND

[76] Inventor: Armand Delaurier, 223 Notre Dame St., Winnipeg, Manitoba, Canada, R2H 0C4

[21] Appl. No.: 103,719

[22] Filed: Aug. 10, 1993

[51] Int. Cl.[5] ..... A63B 71/02; A63C 19/06; G01B 3/10; G01C 15/00

[52] U.S. Cl. ..... 33/1 G; 33/755; 33/562; 273/25

[58] Field of Search ..... 33/1 G, 755, 756, 759, 33/761, 762, 562, 566; 273/25

[56] References Cited

U.S. PATENT DOCUMENTS

| | | | |
|---|---|---|---|
| 756,632 | 4/1904 | Herrick | 33/755 |
| 3,039,197 | 6/1962 | Abbott | 33/755 |
| 3,668,781 | 6/1972 | Teter | 33/755 |
| 4,160,324 | 7/1979 | Dunn | 33/759 |
| 4,267,637 | 5/1981 | Paull | 33/1 G |
| 4,937,949 | 7/1990 | Kiefer | 33/1 G |
| 5,107,595 | 4/1992 | Stay et al. | 33/1 G |
| 5,280,092 | 1/1994 | Milburn | 33/756 |

FOREIGN PATENT DOCUMENTS

| | | | |
|---|---|---|---|
| 4739 | of 1886 | United Kingdom | 33/755 |
| 2213 | of 1889 | United Kingdom | 33/755 |
| WO85/04110 | 9/1985 | WIPO | 273/25 |

*Primary Examiner*—William A. Cuchlinski, Jr.
*Assistant Examiner*—G. Bradley Bennett
*Attorney, Agent, or Firm*—Adrian D. Battison; Murray E. Thrift; Stanley G. Ade

[57] ABSTRACT

A reel dedicated to the layout of a baseball diamond includes a tape with an inner end reeled onto a reel body and an outer end attached to the reel body to form a loop of the tape. The loop has a length $2x+\sqrt{2}x$ and has a first base marking at a distance x from the outer end, a second base marking at a distance 2x from the outer end, a third base marking at a distance $x+\sqrt{2}x$ from the outer end and a pitcher's plate marking at a distance of y from the inner end. x is equal to the required distance between bases. y is equal to the distance of the pitcher's plate from home base. The loop is pulled out into a first triangle from first base to second base and back to home plate and then in a second triangle from home plate to first base and to third base to accurately lay out the positions of pegs.

6 Claims, 4 Drawing Sheets

STEP 4

STEP 5

STEP 6

METHOD AND TAPE CONSTRUCTION FOR LAYING OUT A BASEBALL DIAMOND

BACKGROUND OF THE INVENTION

This invention relates to a method for laying out a baseball diamond and to a reel of tape arranged for use in laying out a baseball diamond.

The baseball diamond has, as you well know, three bases, home plate and a pitcher's mound. The bases are spaced by a pre-determined distance which can vary depending upon the variety of the game being played. It is of course highly desireable that the angles of the diamond be accurate so that the diamond is properly "square".

Many baseball diamonds are permanently layed out and marked. In other situations, generally in recreational baseball, it is necessary to mark out the diamond on a bare ground before the game is commenced. In the latter case particularly but also generally, it is desireable that the locations for the bases relative to home plate be positioned accurately and quickly.

It's one object of the present invention, therefore, to provide an improved method for laying out the base markers for a baseball diamond.

It's the second object of this invention to provide an improved tape reel which can be used in laying out a baseball diamond.

SUMMARY OF THE INVENTION

According to a first aspect of the invention there is provided a method of laying out a baseball diamond comprising providing a loop of tape, defining on the loop a base position for locating at home base, defining on the tape a first marking indicative of first base, a second marking indicative of second base and a third marking indicative of third base, the first marking being located at a distance x from the base position, the second marking being located along the loop of tape beyond the first position at a distance 2x from the base position, the third marking being located along the loop of tape beyond the second position at a distance $x+\sqrt{2}x$ from the base position, the length of the loop being equal to $2x+\sqrt{2}x$, where x is equal to the required distance between bases, locating the base position at a home base marker at a point on the ground selected as home base, pulling the loop in a direction toward an intended location of first base, locating a first base marker on the ground at a position measured by the tape indicated by said first marking, pulling the loop around the first base marker until the loop is taut and forms a first triangle with the apexes at the base position, at the first base marker and at the second marking, placing a second base marker at the second marking, pulling the loop around the first base marker until the loop is taut and forms a second triangle with the apexes at the base position, at the first base marker and the third marking, and placing a third base marker at the third marking.

According to a second aspect of the invention there is provided a reel of tape for laying out the baseball diamond comprising a reel body, a tape wound onto the reel body so as to define an inner end on the reel and an outer end, means on the outer end for attachment of the outer end to the reel body, a first marking on the tape indicative of first base, a second marking on the tape indicative of second base and a third marking on the tape indicative of third base, the first marking being located at a distance x from the outer end, the second marking being located along the loop of tape beyond the first position at a distance 2x from the outer end and the third marking being located along the loop of tape beyond the second marking at a distance $x+\sqrt{2}x$ from the outer end, the length of the tape from the inner end to the outer end being equal to $2x+\sqrt{2}x$, where x is equal to the required distance between bases.

One embodiment of the invention will now be described in conjunction with the accompanying drawings in which:

BRIEF DESCRIPTION OF THE DRAWINGS

FIG. 2 is a series of steps for use of the tape of FIG. 1 in the method of laying out a baseball diamond.

In the drawings like characters of reference indicate corresponding parts in the different figures.

DETAILED DESCRIPTION

Figure 1:
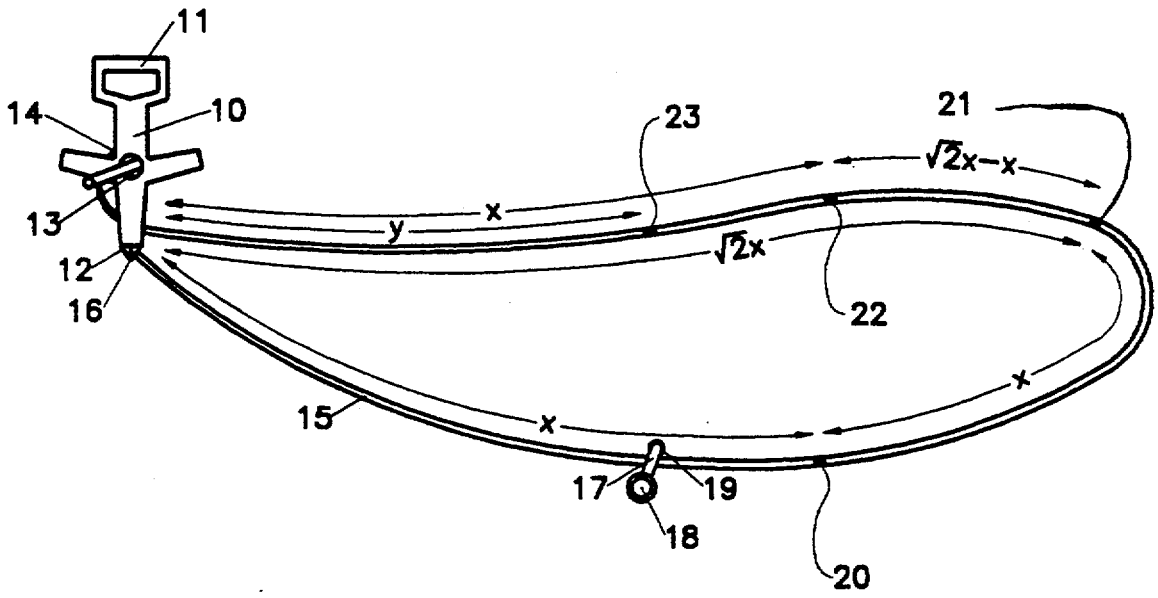
FIG. 1 is a schematic isometric view of a reel and tape according to the present invention.
Figure 1A:
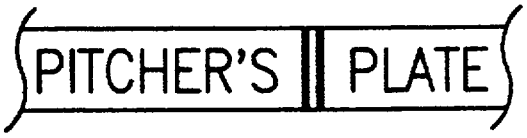
FIGS. 1A, 1B, 1C and 1D show the details of the indicia on the tape of FIG. 1.
Figure 1B:
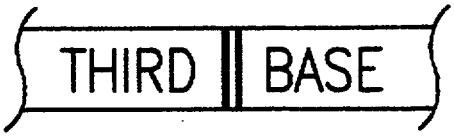
Figure 1C:
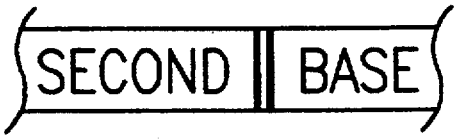
Figure 1D:
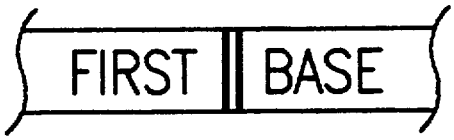
Figure 2A:
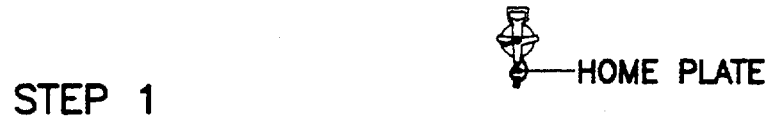
FIG. 2A, 2B, 2C, 2D, 2E and 2F show a series of steps for use of the tape of FIG. 1 in the method of laying out a baseball diamond.
Figure 2B:
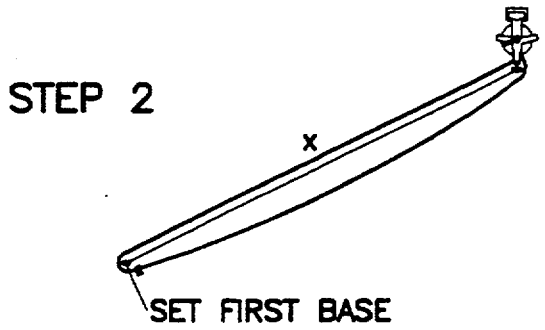
Figure 2C:
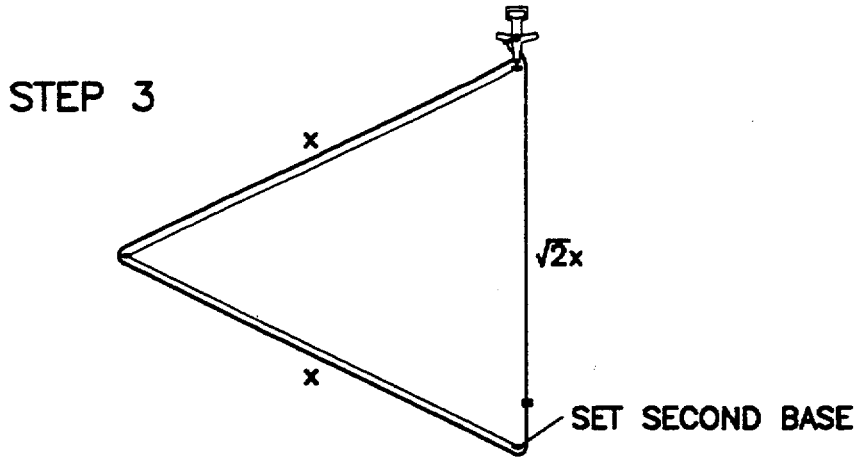
Figure 2D:
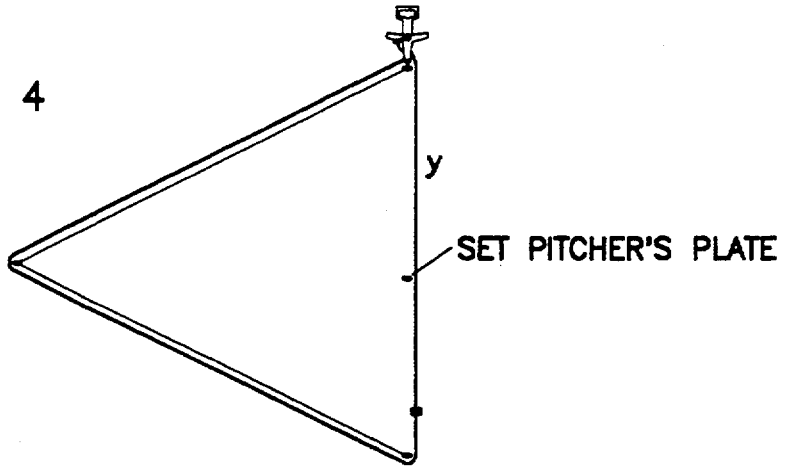
Figure 2E:
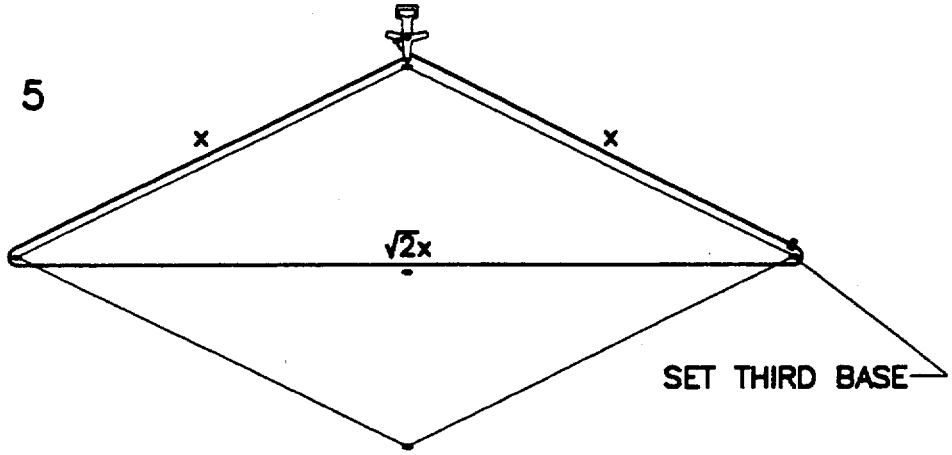
Figure 2F:
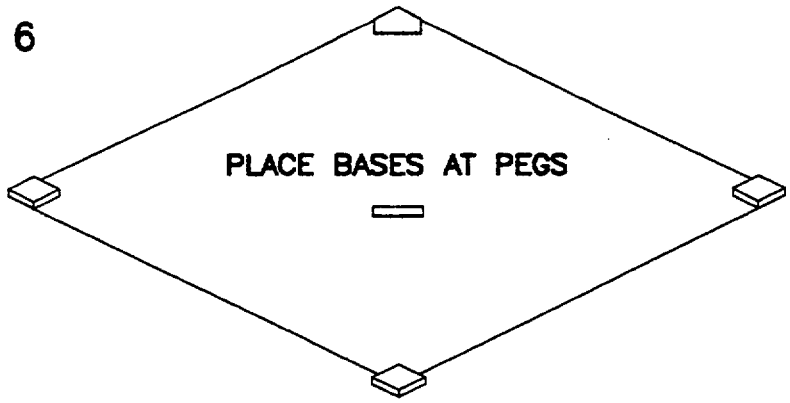

The tape and reel as shown in FIG. 1 are basically conventional in that the reel comprises a reel body 10 with a handle 11 by which the reel can be lifted and moved from place to place. At the lower end of the reel body is provided a pointed lower member 12 which can be placed on the ground at a required location. The reel body carries a shaft 13 to which an inner end 14 of the tape 15 is attached. An outer end 16 of the tape is attached back to the reel body for example at the pointed member 12 to form a loop of the tape of a predetermined length. The tape can thus be reeled onto the body to be carried with the reel or can be pulled out in a loop as shown in FIG. 1.

In addition to the conventional reel and tape there is provided a slide member 17 with a manually graspable portion 18 and a roller 19 which allows the slide member to slide along the tape to assist in pulling the loop from the reel and manually manipulating the loop without sliding the loop against the fingers of the user.

The tape is modified by the provision of four markings including a first marking 20, a second marking 21, a third marking 22 and a fourth marking 23. The first marking as shown in the drawing is indicative of first base and includes a specific location mark on the tape together with the words "FIRST BASE". The second marking 21 and the third marking 22 are similar to the first markings except that they designate or indicate "SECOND BASE" and "THIRD BASE" respectively. The fourth marking 23 is again similar but includes the words "PITCHER'S PLATE".

The markings are located on the tape such that the first marking is spaced from the outer end of the tape by distance x, the second base marking is spaced from the first base marking by a distance x that is by a distance 2x from the outer end. The third base marking is spaced from the inner end by a distance x. The full length of the loop is equal to $2x+\sqrt{2}x$. Thus the distance between the second base marking and the third base marking is equal to $\sqrt{2}x-x$. The pitcher's plate marking is spaced from the inner end by a distance y. The distance x is equal to the required spacing between the bases. The distance y is equal to the required distance of the pitcher's mound from home plate. These distances are specified in the particular variety of game concerned and these distances vary from 60 feet in some cases up to 90 feet in other cases.

Turning now to FIG. 2, the steps of use of the tape and reel of FIG. 1 are shown schematically. In the first step a peg is placed in the ground at a selected location for home plate on an unmarked field or a field in which the diamond is to be marked. The point of the reel is located at the peg to start the layout. The reel is held at this position permanently until the layout is complete.

In step 2 the pulley 17 is grasped and four further pegs are carried with the operator while the operator walks toward the desired location of first base. As the tape is pulled out, the operator watches for the first marking and on reaching the first marking grasps the tape at the point, pulls the tape taut and straight and locates the peg at the required position. This position can be moved in an arc around home plate until it is best located for the orientation of the diamond on the field. The tape is then wrapped around the upstanding peg.

In step 3 the operator grasps again the pulley 17 and walks away from the peg pulling the tape around the peg while walking in the general direction of second base. The operator watches again for the second marking and on reaching the second marking grasps the tape at that point and then pulls the tape into a taut triangle with the apexes of the triangle arranged at home plate, at the peg at first base, and at the second marking. With the tape taut and the triangle having straight sides, the position of second base is thus located and the second peg is applied at this position. The peg for second base is positioned inside the loop so as to hold the tape taut in the first triangle.

In step 4 the operator leaves the tape in the first triangle and walks along the tape toward home plate to locate the fourth marking. A peg is then applied into the ground at the fourth marking to identify the position of the pitcher's plate. The fourth marking is located at the required spacing from home plate that is at the distance y from the inner end of the tape.

In step 5, the tape loop is removed from the second peg and the operator walks in the general direction of third base while pulling the tape loop by grasping the pulley 17. At the same time the operator looks for the third marking and on reaching this marking grasps the tape at that point and pulls it so that it forms a second triangle with the apexes at home plate, at the peg at first base and at the third marking. The fourth peg is then applied to the ground at the third base marking with the triangle held taut.

The tape is then removed from the pegs and rewound onto the reel. The pegs thus indicate the positions of the bases and the pegs can be removed and the necessary bases placed in position at exactly the required location.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A method of laying out a baseball diamond comprising providing a loop of tape, defining on the loop a base position for locating at home base, defining on the tape a first marking indicative of first base, a second marking indicative of second base and a third marking indicative of third base, the first marking being located at a distance x from the base position, the second marking being located along the loop of tape beyond the first position at a distance 2x from the base position, the third marking being located along the loop of tape beyond the second position at a distance $x+\sqrt{2x}$ from the base position, the length of the loop being equal to $2x+\sqrt{2x}$, where x is equal to the required distance between bases, locating the base position at a home base marker at a point on the ground selected as home base, pulling the loop in a direction toward an intended location of first base, locating a first base marker on the ground at a position measured by the tape indicated by said first marking, pulling the loop around the first base marker until the loop is taut and forms a first triangle with the apexes at the base position, at the first base marker and at the second marking, placing a second base marker at the second marking, pulling the loop around the first base marker until the loop is taut and forms a second triangle with the apexes at the base position, at the first base marker and the third marking, and placing a third base marker at the third marking.

2. The method according to claim 1 including providing a pitcher's plate marking on the tape at a position along the tape beyond the third marking and, with the loop in the first triangle, locating a pitcher's plate marker on the ground at the pitcher's plate marking.

3. The method according to claim 1 including winding the tape onto a reel so as to define an inner end on the reel and an outer end and attaching the outer end to the reel so as to form the loop of tape between the inner end and the outer end.

4. The method according to claim 3 including providing a slide member slideable on the tape and grasping the loop by the slide member.

5. A reel of tape for laying out a baseball diamond comprising a reel body, a reel rotatably mounted on the reel body, a tape wound onto the reel so as to define an inner end attached to the reel and an outer end separate from the reel, means on the outer end for attachment of the outer end to the reel body, a first marking on the tape indicative of first base, a second marking on the tape indicative of second base, a third marking on the tape indicative of third base and a pitcher's plate marking on the tape, the first marking being located at a distance x from the outer end, the second marking being located along the loop of tape beyond the first position at a distance 2x from the outer end, the third marking being located along the loop of tape beyond the second marking at a distance $x+\sqrt{2x}$ from the outer end and the pitcher's plate marking being located at a position along the tape beyond the second marking and arranged at a distance from the inner end equal to the required distance of the pitcher's plate from home base the length of the tape from the inner end to the outer end being equal to $2x+\sqrt{2x}$, where x is equal to the required distance between bases and a slide member which is manually graspable and slideable along the tape for pulling the tape into the loop.

6. A method of laying out a baseball diamond comprising providing a loop of tape, defining on the loop a base position for locating at home base, defining on the tape a first marking indicative of first base, a second marking indicative of second base and a third marking indicative of third base, the first marking being located at a distance x from the base position, the second marking being located along the loop of tape beyond the first position at a distance 2x from the base position, the third marking being located along the loop of tape beyond the second position at a distance $x+\sqrt{2}x$ from the base position, the length of the loop being equal to $2x+\sqrt{2}x$, where x is equal to the required distance between bases, providing a pitcher's plate marking on the tape at a position along the tape beyond the third marking, locating the base position at a home base marker at a point on the ground selected as home base, providing the tape as a continuous tape, providing a slide member slideable on the tape along the full length of the continuous tape and grasping the loop by the slide member, pulling the loop by the slide member in a direction toward an intended location of first base, locating a first base marker on the ground at a position measured by the tape indicated by said first marking, pulling the loop by the slide member around the first base marker until the loop is taut and forms a first triangle with apexes of the triangle at the base position, at the first base marker and at the second marking, placing a second base marker at the second marking, locating a pitcher's plate marker on the ground at the pitcher's plate marking, pulling the loop by the slide member around the first base marker until the loop is taut and forms a second triangle with apexes of the second triangle at the base position, at the first base marker and the third marking, and placing a third base marker at the third marking.

* * * * *